United States Patent [19]

Hawley, Jr.

[11] Patent Number: 4,568,301

[45] Date of Patent: Feb. 4, 1986

[54] MAGNETICALLY CONTROLLED TOY

[75] Inventor: William H. Hawley, Jr., St. Albans, W. Va.

[73] Assignee: John Nicoloudakis, Charleston, W. Va. ; a part interest

[21] Appl. No.: 615,650

[22] Filed: May 31, 1984

Related U.S. Application Data

[63] Continuation-in-part of Ser. No. 521,288, Aug. 8, 1983, abandoned.

[51] Int. Cl.[4] ..... A63H 33/26

[52] U.S. Cl. ..... 446/134

[58] Field of Search ..... 446/129, 132, 133, 134, 446/135, 136; 273/1 M; 272/8 R, 8 N, 8 D; 335/209, 306, 219

[56] References Cited

U.S. PATENT DOCUMENTS

| | | | |
|---|---|---|---|
| 1,595,801 | 8/1926 | McDonald | 446/134 |
| 2,220,049 | 10/1940 | Dunmore . | |
| 2,702,191 | 2/1955 | Lemelson | 446/129 X |
| 3,374,573 | 3/1968 | Bishoff . | |
| 3,478,466 | 11/1969 | Conner . | |
| 3,707,290 | 12/1972 | Birnkrant . | |
| 3,908,307 | 9/1975 | Jacobson . | |
| 4,091,565 | 5/1978 | Sheehan . | |
| 4,178,707 | 12/1979 | Littlefield . | |
| 4,250,659 | 2/1981 | Ishiguro . | |

*Primary Examiner*—Mickey Yu

*Attorney, Agent, or Firm*—Griffin, Branigan, & Butler

[57] ABSTRACT

A flight unit is tethered by a thread to a base with the thread being attached to the flight unit at a point offset from the longitudinal center of gravity of the flight unit so that one end hangs lower than the other end. The flight unit has a bar magnet therein and one or more additional magnets are disposed adjacent the path of movement of the flight unit, the additional magnets being poled to repel one end of the flight unit or attract a second end. The additional magnets cause the flight unit to pivot vertically about the point at which it is attached to the thread, this pivoting movement giving unusual and improved flight characteristics to the flight unit.

11 Claims, 6 Drawing Figures

MAGNETICALLY CONTROLLED TOY

RELATED APPLICATIONS

This application is a continuation-in-part of my copending application Ser. No. 521,288 filed Aug. 8, 1983 now abandoned.

BACKGROUND OF THE INVENTION

The present invention relates to a toy or amusement device having a flight unit whose motion is controlled by a plurality of magnets. The flight unit may be formed to simulate a fish, spider, bird, bee insect or living creature or an airplane, kite or other inanimate flying object.

It is well known to provide magnets, one of which is embedded in a figure-like element to control the movement of the element. Typical devices of the prior art are illustrated in Bishoff U.S. Pat. No. 3,374,573, Dunmore U.S. Pat. No. 2,220,049 and Sheehan U.S. Pat. No. 4,091,565. However, to my knowledge the prior art has not provided a magnetically controlled toy wherein the flight characteristics are enhanced by tethering the element at a point which is offset from its center of gravity along its longitudinal axis such that the element normally assumes a position which is at an angle to both a horizontal and vertical plane extending through the point at which the flight unit is tethered.

SUMMARY OF THE INVENTION

An object of the present invention is to provide a magnetically controlled toy wherein a first bar magnet is embedded in a flight unit and tethered to a base means by a flexible tether means such as a string or thread, at least one additional magnet being disposed in or on the base means. The string or thread is attached to the flight unit such that the bar magnet therein normally assumes an angle with respect to both a horizontal and a vertical plane. The flight unit may be tethered to the base means at a point which is above or below the flight unit with the additional magnet being positioned below or above the flight unit, respectively.

In some embodiments at least two magnets are supported by the base means and disposed close enough to each other and the tethered bar magnet such that attraction of the tethered magnet by one of the magnets on the base means pivots the tethered magnet in a vertical plane thereby bringing the tethered magnet under the influence of the second magnet on the base means.

A further object of the invention is to provide a toy as described above wherein parameters in the toy may be manually varied to thereby vary the flight characteristics of the figure-like element.

An object of the present invention is to provide a magnetically controlled toy as described above for simulating the flight of a bee or humming bird.

Other objects of the invention and its mode of operation will become apparent upon consideration of the following description and the accompanying drawing.

DETAILED DESCRIPTION OF THE INVENTION

Figure 1:
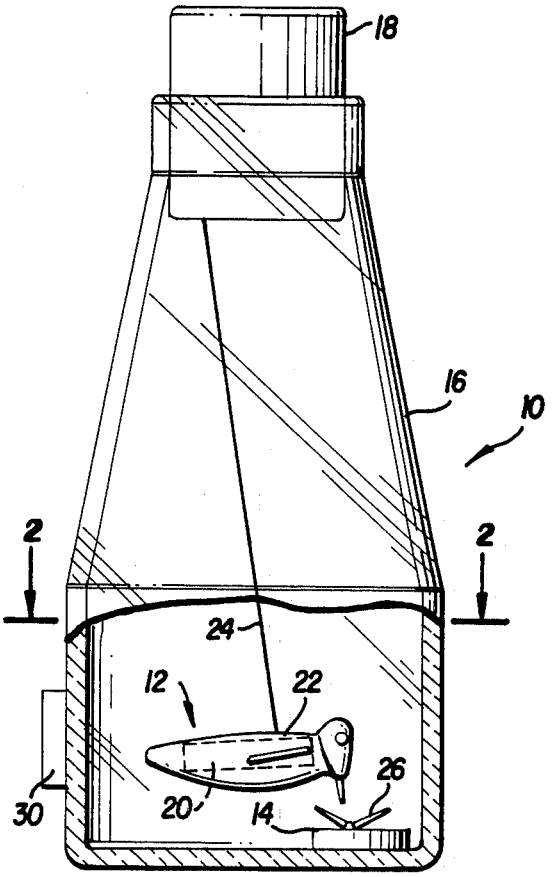
FIG. 1 is a side cut-away view of a first embodiment of the invention.
Figure 2:
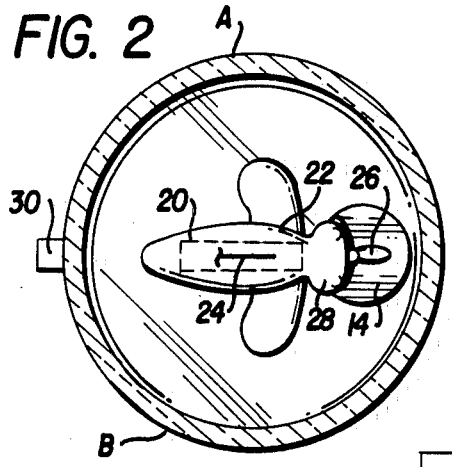
FIG. 2 is a sectional view taken along the line 2—2 of FIG. 1.

As illustrated in FIGS. 1 and 2, a toy constructed in accordance with the principles of the present invention comprises a base means 10, a flight element 12 and a permanent magnet 14.

The base means comprises a container 16 having clear or transparent sidewalls, and a closure 18 which may be in the form of a cork or plastic stopper. Alternatively, the closure may be a threaded cover or cap if the container 16 is also threaded.

The flight element 12 comprises a bar magnet 20 embedded within a figure-like body 22 simulating, for example, a bee. A flexible tether means such as a fine string or thread 24 is attached at one end to stopper 18 and at the other end to the flight element. Preferably the magnet 14 is offset from a vertical line extending through the point where thread 24 is attached to the stopper 18. The offset distance and field strengths of the magnets are chosen such that the bar magnet 20 is normally attracted toward and "captured" by the magnet 14 so that the thread 24 does not normally extend perpendicular to a horizontal plane. This position is illustrated in FIG. 1. Also, to obtain improved flight characteristics the thread is attached to the flight unit 12 at a point offset from its center of gravity along the longitudinal axis of magnet 20 such that in the absence of external magnetic fields the left or tail end (as viewed in FIG. 1) hangs lower than the right or head end.

Figure 5:
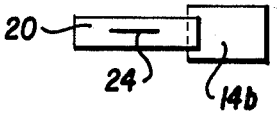
FIG. 5 illustrates the arrangement of two bar magnets when used in the embodiment of FIG. 1; and, FIG. 6 is a part-sectional view of an embodiment wherein the force of gravity on a flight unit is counteracted by the attraction of a magnet located above the flight unit.

The magnet 14 may be a magnetic disc as illustrated in FIG. 2 or it may be a bar magnet as illustrated by magnet **14*b* in FIG. 5. In FIG. 5, the magnet 14*b* should be positioned such that its magnetic pole closest to the point of attachment to stopper 18 is of opposite polarity to the pole of bar magnet 20 which is closest to the head of body 22. In FIGS. 1 and 2, the uppermost pole of magnet 14 should be of opposite polarity to the pole of bar magnet 20 which is closest to the head of body 22**.

In the absence of movement of container 16, the flight element will assume the position shown in FIGS. 1 and 2 and appear to hover with the head 28 over magnet 14. A simulated flower blossom 26 may be mounted over the magnet 14 so that the "bee" appears to be gathering nectar from the blossom.

If the container is moved horizontally and the movement stopped, the "bee" will continue to hover or move with its head over the blossom. Because the head of the bee is attracted toward the magnet 14 there is a tendency for the head to move in a small arc while the tail end of the bee moves with a larger amplitude arcuate movement. The movement may continue for several minutes after the movement of the container is stopped.

The flight characteristics of the flight element 12 may be varied by providing a second bar magnet 30 which is a completely separate element which may be moved around on the outside of container 16 so that a user may vary the flight characteristics as he or she wishes. The magnet 30 may also be used to initiate movement of the flight element 12 even though container 16 remains stationary.

The relative field strengths of the magnets 14, 20 and 30 are chosen such that, absent movement of container 16, the flight element always maintains an orientation such that the head of the "bee" remains substantially over the blossom 26 and the tail end of the flight element, if initially at rest, is not drawn to the inner wall of container 16 as magnet 30 is moved around the outer surface of the container between approximately points A and B.

The bar magnet 30 may be used to vary the flight attitude of the flight element 12. If bar magnet 30 is positioned vertically as shown in FIG. 1, with its upper pole being of opposite polarity to the pole in the "tail" of the flight element, the flight element will rotate in a vertical plane about the point of connection to thread 24 so that bar magnet 20 is almost horizontal. On the other hand, if magnet 30 is rotated 180° from that position so that its pole having a polarity opposite to that of the tail pole of the flight element is below the tail pole, the flight element will rotate in a vertical plane about its point of connection to thread 24 so that the bar magnet 20 assumes a position which is at an angle of approximately 45° to a horizontal plane. When magnet 30 is in either of these positions, the flight element 12 "jiggles" rapidly in a vertical plane because of arcuate movement of thread 24 and there is relatively small amplitude movement of the tail of the flight element in a horizontal plane.

If bar magnet 30 is rotated 90° from the position shown in FIG. 1 so that its poles are in substantially the same horizontal plane, the tail portion of the flight element tends to exhibit larger amplitude lateral movement with relatively small amplitude vertical movements.

The embodiment illustrated in FIGS. 1, 2, and 5 is particularly suitable as a toy for small children. The container 16 and closure 18 may be made of plastic which is not easily breakable. The closure may be permanently sealed to the container so that a child cannot gain access to the small parts inside the container. If a magnet 30 is provided, it should be encased in a piece of plastic large enough to prevent a child from getting it into his or her mouth and the plastic preferably should be shaped to conform to the configuration of the outer surface of container 16. The magnet 30 is preferably molded into the bottom of container 16 to reduce the possibility of dislodgement in case of a sudden impact but it may be glued to the inside bottom of the container if desired.

The flight element 12 of FIG. 1 may take forms other than a bee. Thus, the flight element may be configured to simulate a bird, flying insect, spider, fish or other living creature. The flight element may also be configured to simulate flying inanimate objects such as airplanes, kites, etc. The flower 26 may be replaced with other objects or enhancements normally found in the environment of the object or creature represented by the body 22. For example, if the body 22 is a replica of a spider a web may be painted on the interior of the container 16.

If the strengths of the magnets, the weight of the flight unit, and length of the string 24 are properly chosen, the toy of FIG. 1 may be turned upside down and the flight unit will remain suspended within the container. The magnet 14 pulls the flight unit upwardly until the thread 24 is extended to its full length. The action of the flight unit remains the same as described above. However, the flight unit, illustrated as a bee, will appear to be flying upside down.

Figure 6:
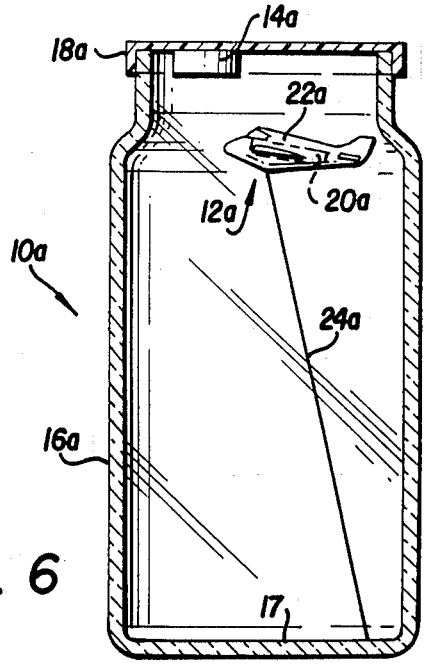

FIG. 6 illustrates an embodiment which achieves the same result as turning the embodiment of FIG. 1 upside down, but permits the flight unit **12*a* to assume the correct flight orientation. In FIG. 6, a magnet 14*a* is glued or otherwise attached to or embedded in a threaded closure 18*a* while one end of a thread or other suitable tether 24*a* is attached to the inside bottom surface 17 of the container 16*a*. The other end of thread 24*a* is attached to the underside of flight unit 12*a* at a point offset from the center of gravity and along the longitudinal axis of the flight unit. The magnet 14*a* is preferably offset from a vertical line extending through the point where thread 24*a* is attached to surface 17. A further magnet 30*a*, like magnet 30**, may be provided.

The embodiment of FIG. 6 operates in essentially the same manner as the embodiment of FIG. 1 except that the flight unit **12*a* appears to the viewer as though it were "flying" at the end of thread 24*a*, the attraction of magnet 20*a* by magnet 14*a* being against the pull of gravity because magnet 14*a* is located above magnet 20*a*. In order to initiate operation of the embodiment of FIG. 6 it is necessary to first invert the container so that the flight unit falls toward magnet 14*a* until restrained by thread 24*a*. At this point the container is slowly rotated to an upright condition, the flight unit being attracted by magnet 14*a*** against the pull of gravity and the thread remaining taut.

In both embodiments (FIGS. 1 and 6) a flight unit 12 or **12*a* is connected to a member 18 or 17 comprising part of a base means 10 or 10*a* by a tether 24 or 24*a* and a magnet 20 or 20*a* in the flight unit is attracted by a further magnet 14 or 14*a*** mounted on or in a member forming part of the base means.

Figure 3:
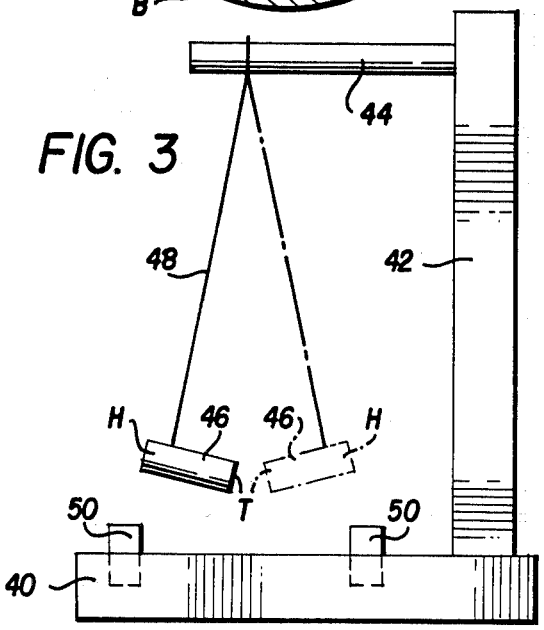
FIG. 3 is a side view of a second embodiment of the invention.
Figure 4:
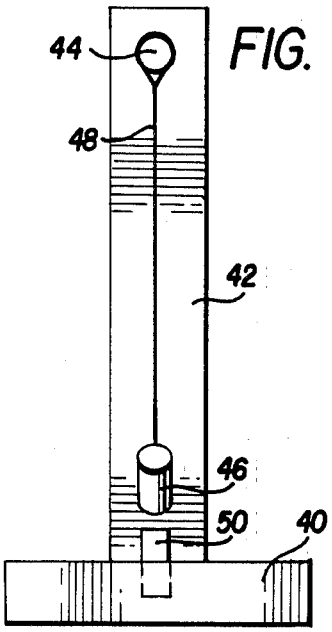
FIG. 4 is a left side view of FIG. 3.

FIGS. 3 and 4 illustrate a second embodiment of the invention particularly suited for simulating the darting movement of a humming bird as it moves from one flower blossom to another. The embodiment of FIGS. 3 and 4 includes a base means comprising a base member 40, a vertically extending member 42 attached to the upper surface of base member 40, and a horizontal support arm 44 attached to member 42. A flight element comprises a bar magnet 46 preferably encased in a figure-like element (not shown) such as a humming bird with H designating the head end and T designating the tail end. The bar magnet is attached by a tether such as a fine string or thread 48 to the horizontal support arm 44. Two bar magnets 50 and 52 are mounted on or in base member 40 with like poles being uppermost.

The thread 48 may be wrapped around arm 44 and tied at a point which lies in a plane that is equidistant from two permanent magnets 50 and 52 at all points in the plane. At its lower end, thread 48 is affixed to the flight element at a point closer to head end H than tail end T such that the bar magnet 46 normally (i.e. in the absence of external magnetic fields) hangs at an angle with respect to a horizontal plane with the tail end being lower than the head end.

The bar magnets 50 and 52 are substantially equal in magnetic field strength but both have a field strength greater than that of magnet 46. The uppermost poles of magnets 50 and 52 are of like polarity with this polarity being opposite to the polarity of the head end of magnet 46. Simulated flowers, not shown, may be attached to the tops of magnets 50 and 52.

The embodiment of FIGS. 3 and 4 operates as follows. The user pushes either thread 48 or magnet 46 so that the flight unit swings across the magnetic fields of magnets 50 and 52. One of the magnets, say magnet 50, will quickly attract the head end of the flight unit and as the flight unit moves closer to the attracting magnet 50 the head end of the flight unit is drawn downwardly toward the magnet. As the head end is drawn downwardly, the tail end of magnet 46 pivots upwardly. Because the thread 48 is attached nearer to the head than the tail of the flight unit, the weight of the tail end counterbalances the pull of magnet 50 and the flight unit "flies" at the correct attitude with respect to the flower on magnet 50.

The weight of the pivoting tail and the attraction of magnet 50 result in counterbalancing forces which pivot the magnet 46 in a vertical plane about its point of attachment to thread 48. This pivoting motion will at first be of sufficient magnitude such that the tail T of magnet 46 will move into the field of magnet 52. This results in tail T being repelled with sufficient force such that magnet 46 pivots on thread 48 and then swings into the influence of magnet 52 to the position shown in phantom outline in FIG. 3. The action between magnets 46 and 52 is then the same as the action between magnets 46 and 50 as previously described.

The magnet 46 may shift back and forth several times between the alternate positions shown in FIG. 3 before it is eventually "captured" by the field of one of the magnets 50 and 52 and the momentum of the magnet 46 is insufficient to break the magnet 46 free of the field. The magnet 46 will then settle over the magnet 50 or 52, pivoting in a vertical plane about its point of attachment to thread 48. If the magnet 46 is covered with a body simulating a humming bird, this pivoting motion closely approximates the movement of the humming bird as it drinks nectar from a blossom.

The flight characteristics of the magnet 46 may be varied by varying the length of thread 48. By rotating thread 48 about support arm 44 to raise the magnet 46, the magnet will shift back and forth between magnets 50 and 52 more times before it is finally captured by one of the magnets. However, once captured the continuing rapidity of body movement is reduced because the magnet 46 is now further from the magnets 50 and 52.

In summary it is seen that the present invention provides a toy, amusement device or novelty item which may closely simulate the flight of a bee or humming bird. If desired, replicas of butterflies, flying or crawling insects, fish, spiders, and other living creatures as well as replicas of inanimate objects such as airplanes, kites, etc. may be substituted for the bee or humming bird. However, the suspension of the flight unit at a point which is not at its center of gravity causes motion in a vertical plane about the point of suspension and thus induces movement which is more characteristic of the bee or humming bird.

While preferred embodiments of the invention have been described in specific detail, it will be obvious that various modifications and substitutions may be made in the described embodiments without departing from the spirit and scope of the invention as defined in the appended claims.

The embodiments of the invention in which an exclusive property or privilege is claimed are defined as follows:

1. A magnetically controlled toy comprising:

a flight unit having a head end and a tail end and including a bar magnet disposed longitudinally therein between said head end and said tail end;

a base means;

a flexible tether means attached to said base means and to said flight unit at a pivot point between said head end and the center of gravity of said flight unit along its longitudinal axis whereby gravity acting on said flight unit pivots said flight unit in a first direction in a vertical plane about said pivot point so that the tail end of said flight unit normally hangs lower than said head end with the axis of said bar magnet at an angle with respect to a vertical and a horizontal plane extending through said pivot point;

second magnet means including a first magnet supported by said base means at a position which is vertically and horizontally offset with respect to the point at which said flexible tether means is attached to said base means;

said bar magnet being disposed in said flight unit so that the pole of said bar magnet closest to said head end is of opposite polarity to the pole of said first magnet closest to said flight unit whereby mutual attraction between said bar magnet and said first magnet causes said flight unit to pivot in a second direction in said vertical plane extending through said pivot point;

the field strengths of said bar magnet and said first magnet, and the longitudinal position of said pivot point along the axis of said flight unit being such that the force of mutual attraction between said bar magnet and said first magnet oppose the force of gravity tending to pivot said flight unit about said pivot point whereby the longitudinal axis of said bar magnet normally assumes a substantially horizontal position.

2. A toy as claimed in claim 1 wherein said second magnet means further comprises a second magnet supported by said base means, said first and second magnets being positioned equidistantly from a vertical line extending through the point at which the flexible tether means is attached to said base means, said first and second magnets being of substantially equal field strengths and having like poles extending in the same direction, the spacing between said first and second magnets and their field strengths being such that when motion is imparted to said flight unit from an external source said flight unit alternately bobs in a vertical plane at first one and then the other of said first and second magnets, said bobbing motion at one of said first and second magnets causing the tail end of said flight unit to be repelled by the other of said first and second magnets to rotate said flight unit horizontally.

3. A toy as claimed in claim 2 wherein said flight unit comprises a replica of a living creature surrounding said bar magnet.

4. A toy as claimed in claim 1 wherein said flexible tether means consists of a flexible string attached at one end to said base means and at the other end to said flight unit at said pivot point.

5. A toy as claimed in claim 1 wherein said flexible tether means is connected to said base means at a location above said flight unit, said first magnet being supported on said base means at a location below said flight unit.

6. A toy as claimed in claim 1 wherein said flexible tether means is connected to said base means at a location below said flight unit, said first magnet being supported on said base means at a location above said flight unit.

7. A toy as claimed in claim 6 wherein said flight unit comprises a replica of an inanimate object surrounding said bar magnet.

8. A toy as claimed in claim 1 wherein said base means comprises a transparent container which completely encloses said second magnet means, said flight unit and said flexible tether means.

9. A toy as claimed in claim 8 and comprising a further magnet means which may be manually moved about the outside of said container to vary the characteristics of movement of said flight unit.

10. A toy as claimed in claim 9 wherein the field strength of said further magnet means acting on said flight unit is such that the head end of said flight unit always hovers over said first magnet as said further magnet means is manually moved about the outside of said container.

11. A toy as claimed in claim 10 wherein said flight unit comprises a replica of a bee surrounding said bar magnet.

* * * * *